US008141876B2

(12) United States Patent
Humphreys et al.

(10) Patent No.: US 8,141,876 B2
(45) **Date of Patent: *Mar. 27, 2012**

(54) BALL ASSEMBLY

(75) Inventors: Peter Humphreys, Somerset West (ZA); Cornelius Frederik Van Der Nest, Cape Town (ZA)

(73) Assignee: Scarlet Ibis Investments 53 (Proprietary) Limited (ZA)

( * ) Notice: Subject to any disclaimer, the term of this patent is extended or adjusted under 35 U.S.C. 154(b) by 142 days.

This patent is subject to a terminal disclaimer.

(21) Appl. No.: 12/226,051

(22) PCT Filed: Apr. 4, 2007

(86) PCT No.: PCT/IB2007/051210

§ 371 (c)(1), (2), (4) Date: Jan. 6, 2009

(87) PCT Pub. No.: WO2007/116348

PCT Pub. Date: Oct. 18, 2007

(65) Prior Publication Data

US 2009/0170397 A1 Jul. 2, 2009

(30) Foreign Application Priority Data

Apr. 7, 2006 (ZA) ..... 06/2881

(51) Int. Cl.
*A63F 9/08* (2006.01)

(52) U.S. Cl. ..... 273/156; 446/126

(58) Field of Classification Search ..... 273/156, 273/157 R, 153 S; 473/614, 594, 577; 446/901, 446/124, 125, 126

See application file for complete search history.

(56) References Cited

U.S. PATENT DOCUMENTS

| | | | | | |
|---|---|---|---|---|---|
| 2,987,318 | A * | 6/1961 | Hammer | 273/157 R |
| 4,050,184 | A * | 9/1977 | Chiari | 273/157 R |
| 4,493,862 | A | 1/1985 | Allbert | |
| 5,100,359 | A * | 3/1992 | Gorio | 273/157 R |
| 5,104,125 | A * | 4/1992 | Wilson | 273/157 R |
| 5,340,349 | A * | 8/1994 | Berg-Fernstrum | 446/901 |
| 5,411,262 | A * | 5/1995 | Smith | 273/157 R |
| 5,826,872 | A * | 10/1998 | Hall | 273/156 |
| 5,853,823 | A | 12/1998 | McKenna | |
| 6,116,979 | A * | 9/2000 | Weber | 273/157 R |
| D529,377 | S * | 10/2006 | Heiss | D9/431 |
| D606,807 | S * | 12/2009 | Humphreys et al. | D7/505 |
| 2005/0073095 | A1* | 4/2005 | Pharaoh | 273/156 |
| 2005/0248090 | A1* | 11/2005 | Anders | 273/156 |
| 2008/0197566 | A1* | 8/2008 | Lee | 273/157 R |
| 2009/0309302 | A1* | 12/2009 | Langin-Hooper | 273/153 S |

* cited by examiner

*Primary Examiner* — Steven Wong

(74) *Attorney, Agent, or Firm* — Skinner and Associates

(57) ABSTRACT

A soccer ball assembly (10) includes a central mounting core (14) defining thirty-two holes and thirty-two construction elements which are mountable to the central mounting core in an arrangement wherein the construction elements extend radially outwardly therefrom. Twenty of the constructions are hexagonal elements (18) which are hexagonal in cross-section and twelve are pentagonal elements (16) which are pentagonal in cross-section. Each construction element has a spigot formation at an inner end thereof which fits into a different one of the holes in the mounting core (14). In the fully assembled condition, the soccer ball assembly resembles a soccer ball.

14 Claims, 8 Drawing Sheets

BALL ASSEMBLY

FIELD OF INVENTION

This invention relates to a ball assembly.

SUMMARY OF THE INVENTION

According to the invention there is provided a ball assembly including:

a central mounting core defining a number of core mounting formations; and a number of construction elements which may be mountable to the central mounting core in an arrangement wherein the construction elements extend radially outwardly from the central mounting core, the construction elements being configured to define a ball when mounted to the central mounting core in an assembled condition of the ball assembly.

Each construction element may include a complementary element mounting formation for releasably mounting each construction element to a different one of the core mounting formations of the central mounting core.

Each construction element may have an inner end and an outer end, with said element mounting formation being defined at the inner end of the construction element.

Each core mounting formation may be in the form of an aperture defined in the mounting core, each complementary element mounting formation being in the form of a spigot formation which is locatable within one of the apertures.

The central mounting core is in the form of a hollow sphere having said apertures defined therein.

Each construction element may include a convexly curved outer panel at the outer end of the construction element which defines part of an outer surface of the ball assembly in an assembled condition thereof, the outer panel having a radius of curvature equivalent to the radius of curvature of the outer surface of the ball defined by the ball assembly in its assembled condition.

Each construction element includes a concave curved inner wall at the inner end of the construction element, the inner wall having a radius of curvature equivalent to the radius of curvature of an outer surface of the central mounting core.

The outer panels of the construction elements may be configured and dimensioned so that peripheral edges of each outer panel are bordered by the peripheral edges of the outer panels of adjacent construction elements in the assembled condition of the ball assembly.

Each construction element may be one of a pentagonal element having a pentagonal configuration when viewed in cross-section and wherein the outer panel has a pentagonal shape in plan view and a hexagonal element having a hexagonal configuration when viewed in cross-section and wherein the outer panel has a hexagonal shape in plan view.

Each pentagonal element may include five side walls of the same shape and configuration, which extend between the outer panel and the inner end of the pentagonal element.

Each hexagonal element may include six side walls of the same shape and configuration, which extend between the outer panel and the inner end of the hexagonal element.

The side walls of the pentagonal elements may have the same shape and configuration as the side walls of the hexagonal elements thereby permitting the side walls of adjacent hexagonal and pentagonal elements to abut each other in the assembled condition of the ball assembly wherein each pentagonal element is surrounded by five hexagonal elements.

Each of the pentagonal and the hexagonal elements may taper from the outer end towards the inner end thereof.

In its assembled condition, the ball assembly may comprise twelve pentagonal elements and twenty hexagonal elements.

Each pentagonal element may be in the form of a pentagonal container.

Each hexagonal element may be in the form of a hexagonal container.

Each pentagonal and each hexagonal container may define an opening at its inner end, through which flowable material that is contained in the container, can flow, in use.

The spigot formation of each pentagonal container and each hexagonal container may define a spout which is in flow communication with said opening.

In its assembled condition, the ball assembly may generally define a truncated icosahedron.

In its assembled condition, the ball assembly may have the appearance of a soccer ball having pentagonal and hexagonal segments on its outer surface.

BRIEF DESCRIPTION OF DRAWINGS

Further features of the invention are described hereinafter by way of a non-limiting example of the invention, with reference to and as illustrated in the accompanying diagrammatic drawings. In the drawings.

DESCRIPTION OF THE PREFERRED EMBODIMENT

Figure 1:
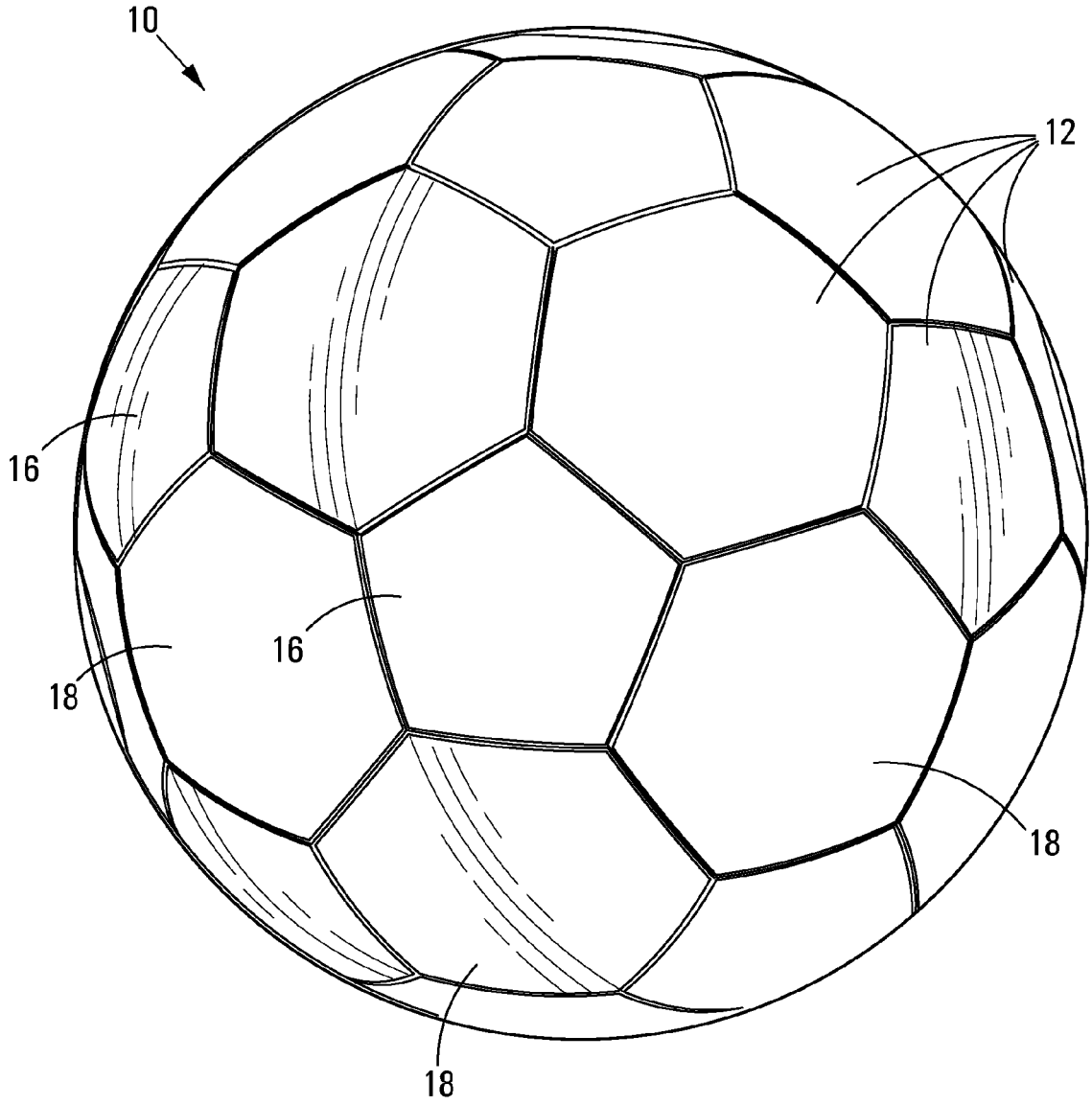
FIG. 1 shows a schematic perspective view of an assembled ball assembly in accordance with the invention.
Figure 2:
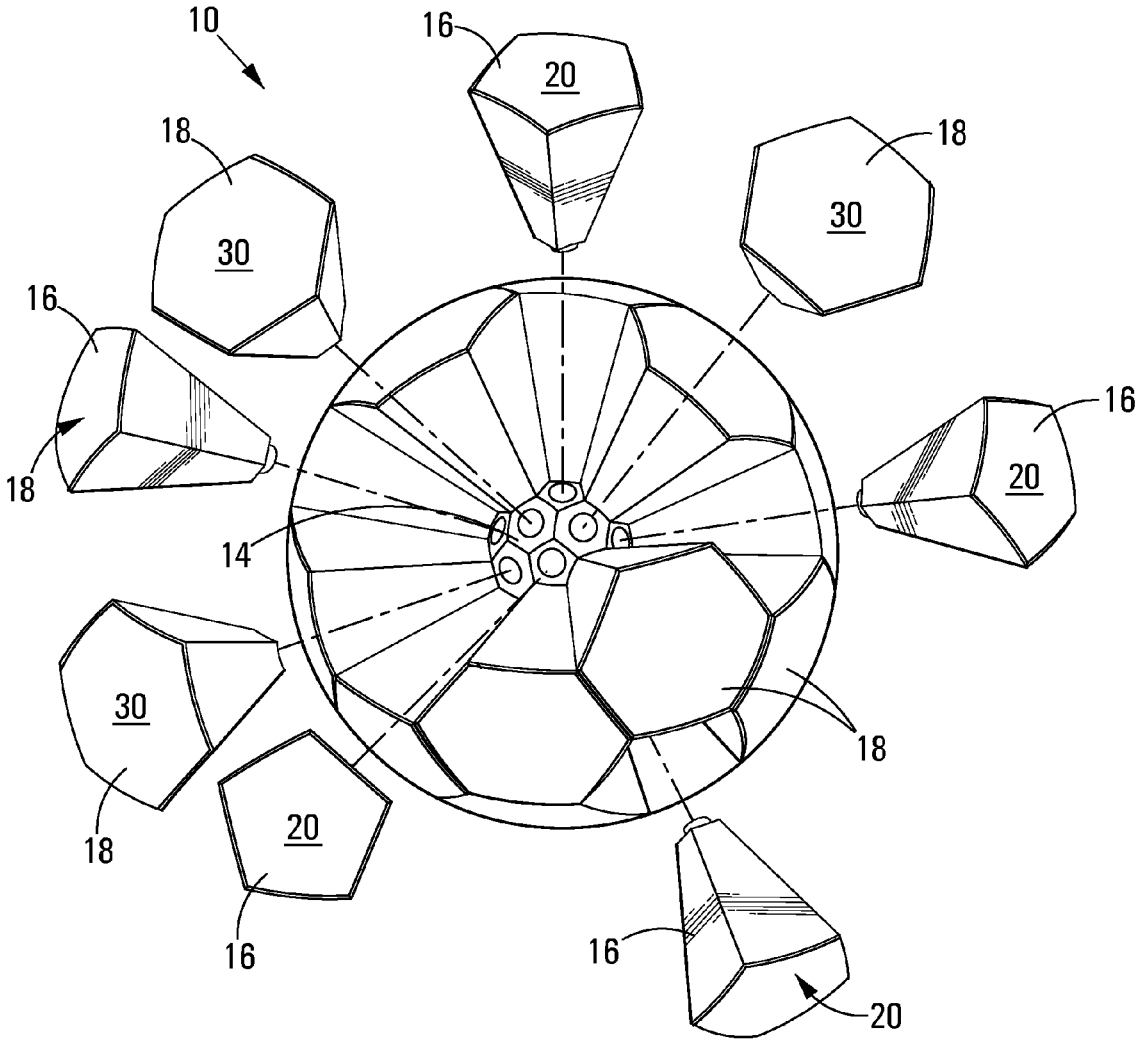
FIG. 2 shows a schematic partially exploded view of the ball assembly of FIG. 1.
Figure 3:
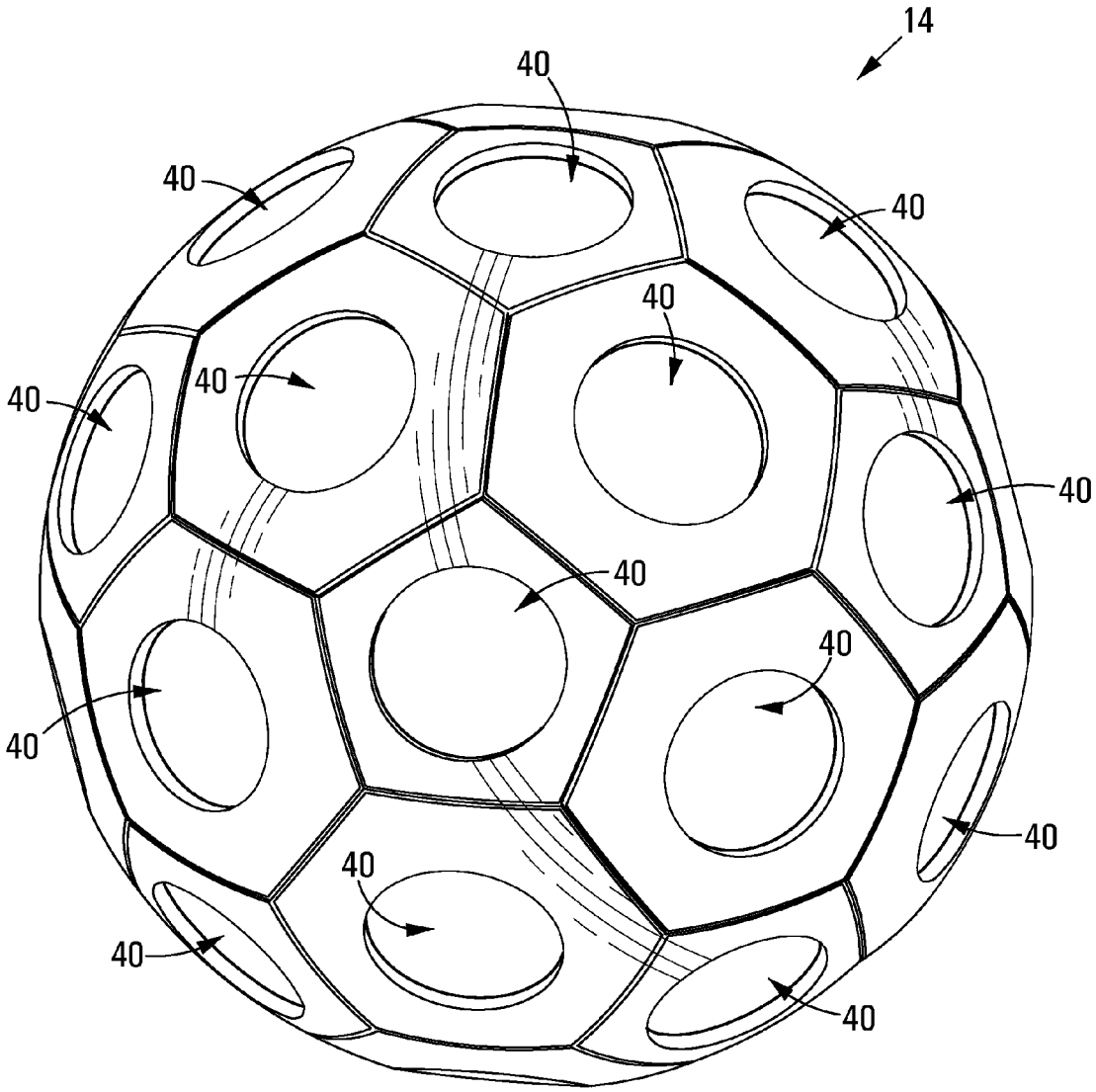
FIG. 3 shows a schematic perspective view of the central mounting core of the ball assembly of FIG. 1.

With reference to the drawings, a ball assembly in accordance with the invention, is designated generally by reference numeral 10. The ball assembly 10 comprises thirty two construction elements in the form of plastics containers 12 and a plastics mounting core 14 to which the containers 12 are mounted in the assembled condition of the ball assembly. In the assembled condition, the ball assembly 10 has a spherical shape and resembles a soccer ball in appearance.

Each container 12 is one of a pentagonal container 16 and a hexagonal container 18. The ball assembly 10 includes twelve pentagonal containers 16 and twenty hexagonal containers 18

The mounting core 14 has a spherical shape and defines thirty-two spaced core mounting formations in the form of apertures 40. The mounting core 14 is hollow and the apertures 40 are in the form of holes defined in the surface of the mounting core.

Figure 4:
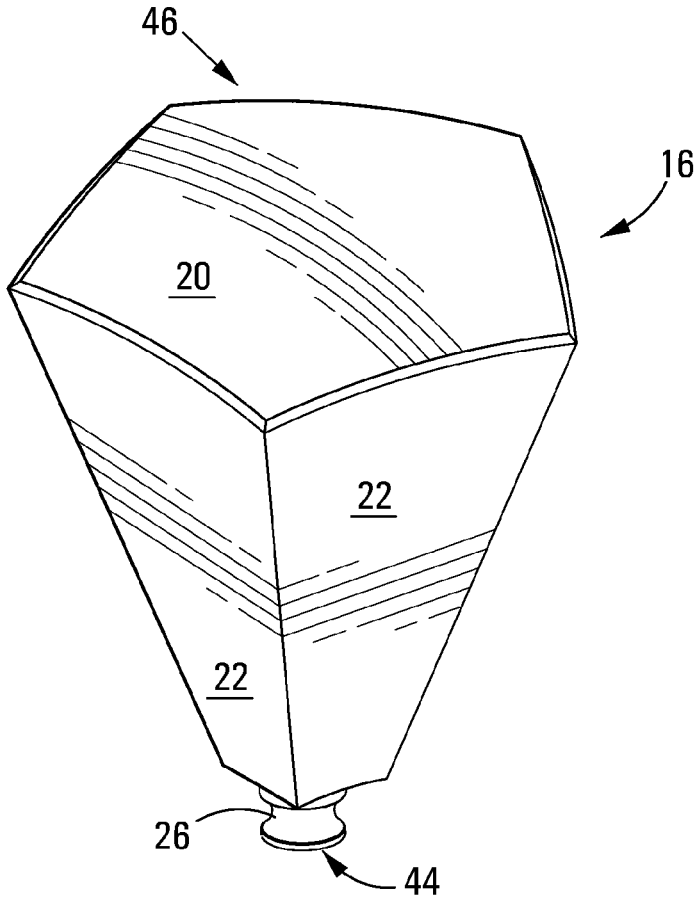
FIG. 4 shows schematic perspective view of one of the pentagonal containers of the ball assembly of FIG. 1, seen from the outer end thereof.
Figure 5:
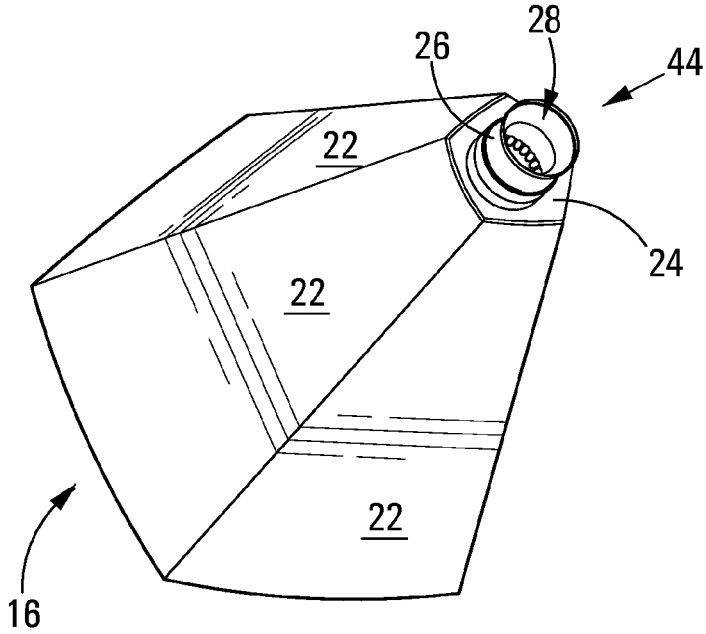
FIG. 5 shows a schematic perspective view of the pentagonal container of FIG. 4, seen from the inner end thereof.
Figure 6:
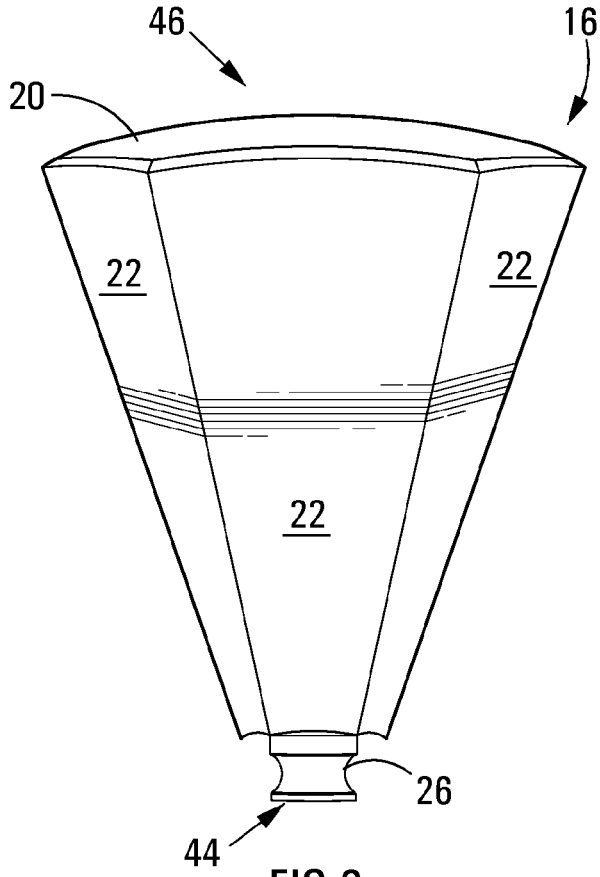
FIG. 6 shows a schematic side view of the pentagonal container of the FIG. 4.
Figure 7:
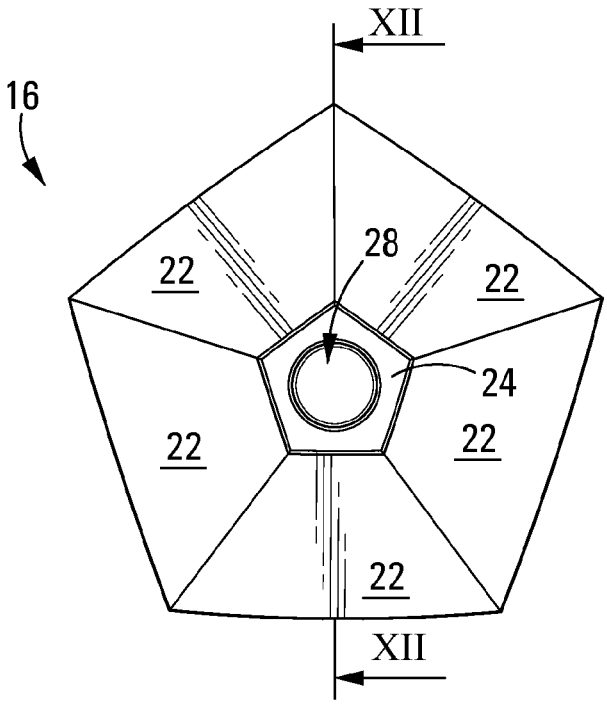
FIG. 7 shows a schematic plan view of the pentagonal container of the FIG. 4, seen from the inner end thereof.

With reference to FIGS. 4 to 7 of the drawings, each pentagonal container 16 defines an inner end 44 and an outer end 46. The pentagonal containers 16 each comprise an outer panel 20 at the outer end 46, five side walls 22 of the same shape and configuration, an inner end wall 24 at the inner end 44, and a container mounting formation in the form of a spigot formation 26 which defines a pouring spout. The outer panel 20 has the shape of a regular pentagon in plan view. The side walls 22 extend between the edges of the outer panel 20 and the end wall 24. Each pentagonal container 16 tapers from the outer end 46 towards the inner end 44 thereof. The shape of the inner end wall 24, in plan view, is similar to the shape of the outer panel 20 and has a pentagonal profile. The outer panel 20 is curved to define a convex outer surface. The inner end wall 24 defines an outlet opening 28 therein. The spout projects from the inner end wall 24 and surrounds the outlet opening 28.

The inner end wall 24 has a concave curved shape so as to conform to the curvature of the mounting core 14. As such, the radius of curvature of the inner end wall 24 is equivalent to the radius of curvature of the outer surface of the mounting core 14.

Figure 8:
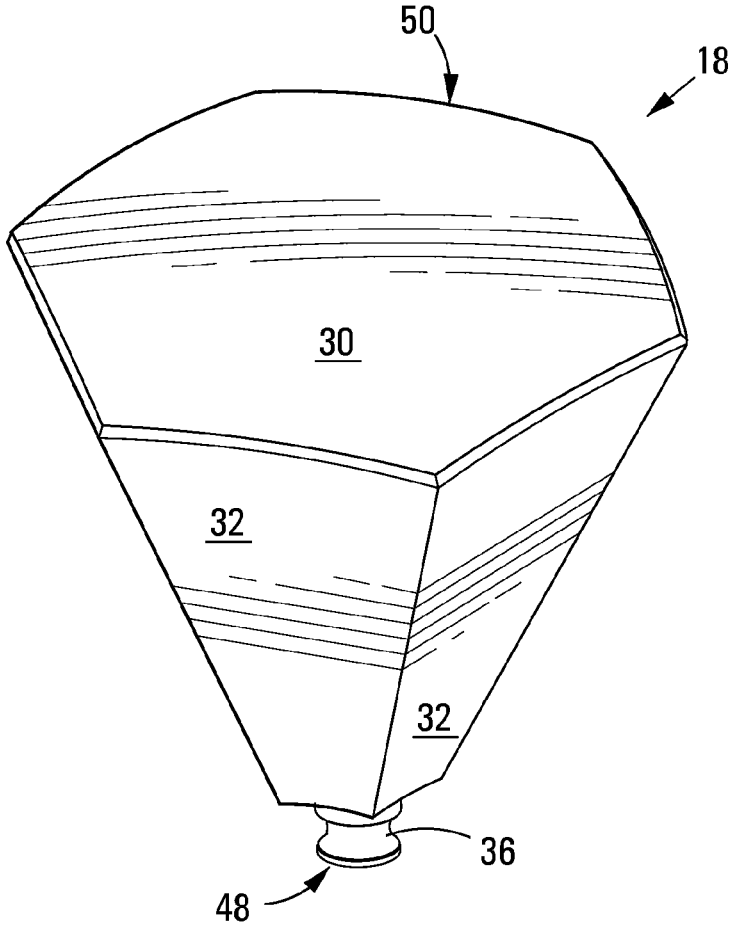
FIG. 8 shows a schematic perspective view of one of the hexagonal containers of the ball assembly of FIG. 1, seen from the outer end thereof.
Figure 9:
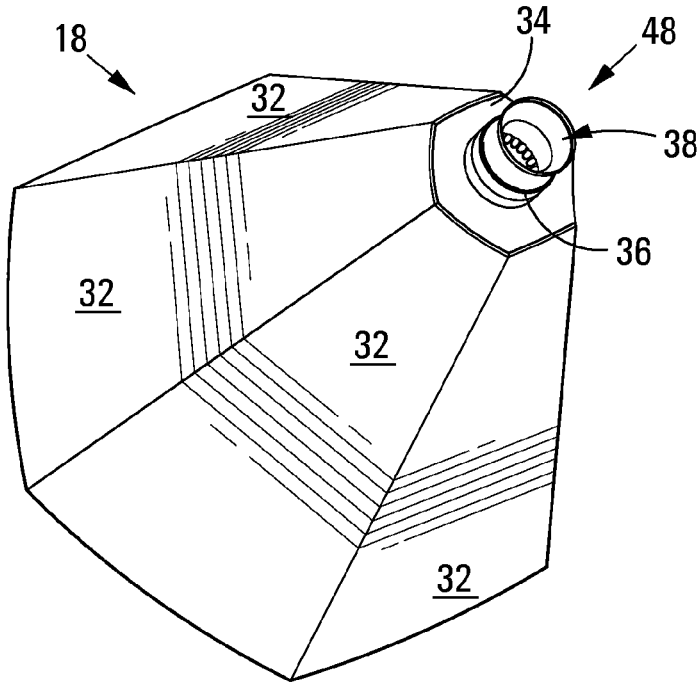
FIG. 9 shows a schematic perspective view of the hexagonal container of the FIG. 8, seen from the inner end thereof.
Figure 10:
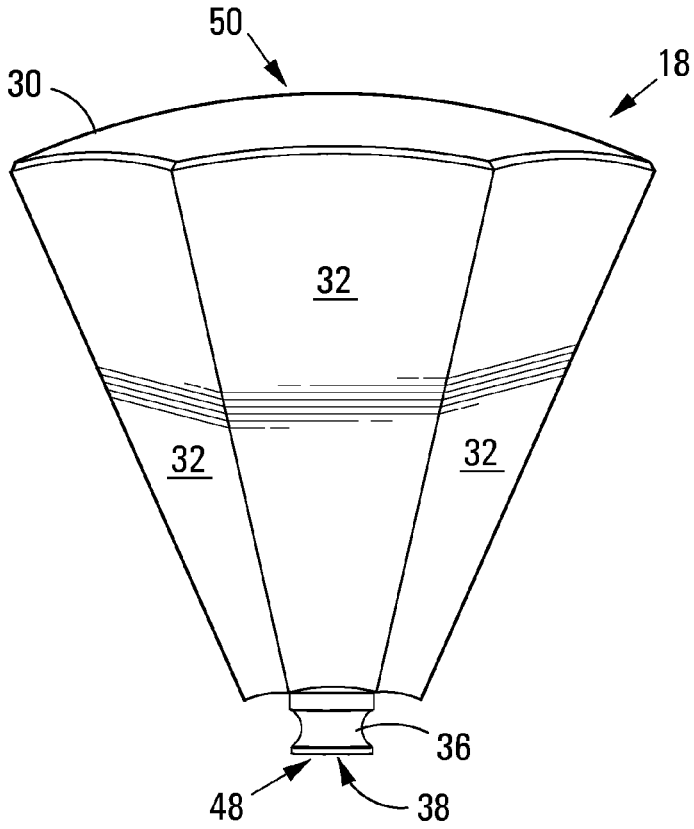
FIG. 10 shows a schematic side view of the hexagonal container of FIG. 8.
Figure 11:
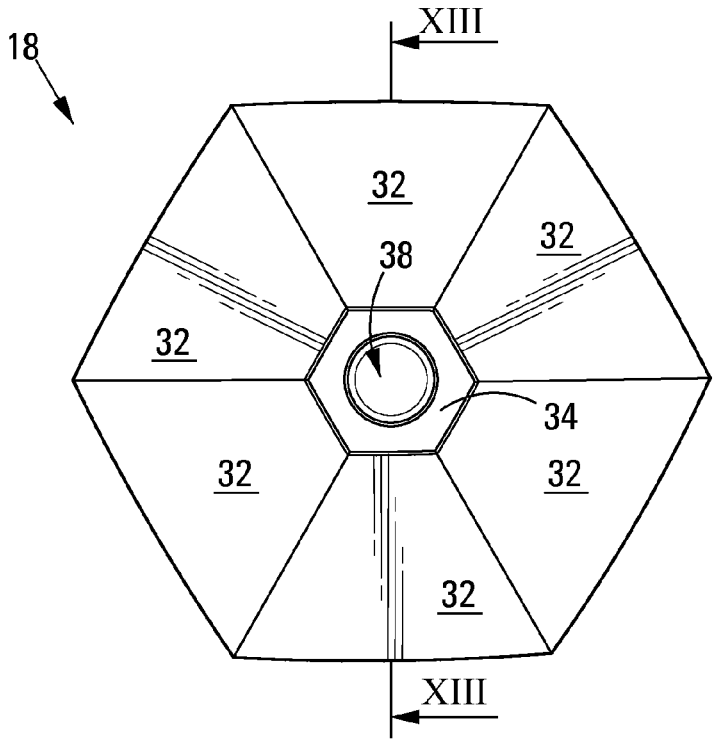
FIG. 11 shows a schematic plan view of the pentagonal container of the FIG. 8, seen from the inner end thereof.
Figure 12:
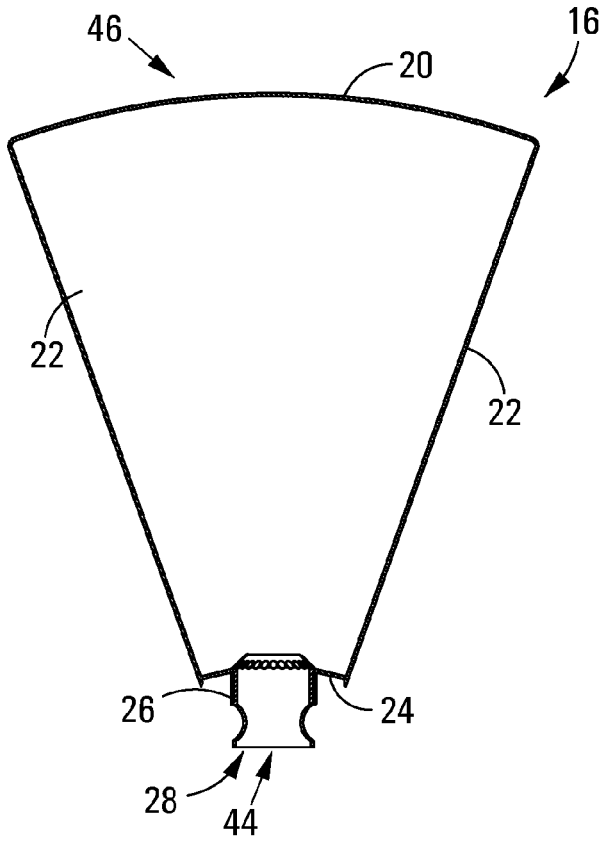
FIG. 12 shows a longitudinal section through the pentagonal container of FIG. 4, sectioned along section line XII-XII of FIG. 7.
Figure 13:
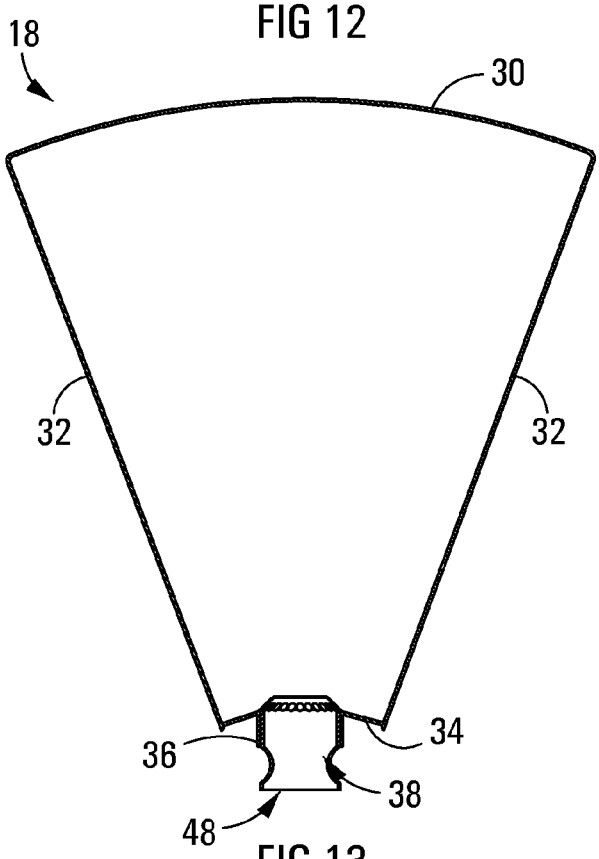
FIG. 13 shows a longitudinal sectional through the hexagonal container of FIG. 8, sectioned along section line XIII-XIII of FIG. 11.

With reference to FIGS. 8 to 11 of the drawings, each hexagonal container 18 defines an inner end 48 and an outer end 50. The containers 18 each comprise an outer panel 30 at the outer end 50, six side walls 32 of the same shape and configuration, an inner end wall 34 defined at the inner end 48, and a container mounting formation in the form of a spigot formation 36 which defines a pouring spout. The outer panel 30 has the shape of a regular hexagon, in plan view. The side walls 32 extend between the edges of the outer panel 30 and the inner end wall 34. Each container 16 tapers from the outer end 50 towards the inner end 48 thereof. The shape of the inner end wall 34, in plan view, is similar to the shape of the outer panel 30 and has a hexagonal profile. The outer panel 30 is curved to define a convex outer surface. The end wall 34 defines an outlet opening 38 therein. The spout is defined on the end wall 34 around the outlet opening 38.

The inner end wall 34 has a concave curved shape so as to conform to the curvature of the mounting core 14. As such, the radius of curvature of the inner end wall 34 is equivalent to the radius of curvature of the outer surface of the mounting core 14.

In the assembled condition, the ball assembly 10 generally defines a truncated icosahedron that is spherical in shape because of the convexity of the outer panels of the containers 12. As such, the curved outer panels 20 and 30 of the pentagonal and hexagonal containers, respectively, define the same radius of curvature which are in turn equivalent to the radius of curvature of the outer surface of the ball defined by the ball assembly 10 in its assembled condition.

In use, the containers 12 can be filled with a flowable material such as a beverage. Each pentagonal container 16 defines an internal volume of 120 ml and each hexagonal container 18 defines an internal volume of 180 ml. The spouts 26, 36 include closures (not shown) rendering the spouts open- and closeable. The Applicant envisages that after the contents of the containers 12 have been consumed, the containers can be assembled by mounting the containers to the mounting core 14 to form the soccer ball-like ball assembly. The containers are assembled by mounting the containers on the core 14 by inserting the spigot formations 26, 36 of the containers into the socket formations of the core. As such, the configuration and dimensions of the apertures 40 of the mounting core 14 and of the spigot formations 26, 36 may be such that the spigot formations are locatable in the apertures in a snug fit. In their assembled condition, the containers 12 extend radially from the mounting core 14 with the edges of each of the outer panels 20, 30 of the containers being bordered by the edges of outer panels 20, 30 of adjacent containers 12 and the side walls of adjacent containers 12 abutting each other. Specifically, each pentagonal container 16 is bordered and abutted on all five sides by a different hexagonal container 18.

The Applicant envisages that the outer panels of the container assembly 10 may include promotional advertising. More specifically the Applicant envisages that the outer panels 20, 30 may be marked with soccer-related advertising such as the names and/or logos of soccer teams.

It will be appreciated that the exact configuration of the ball assembly and the component parts thereof may vary considerably while still incorporation the essential features as defined and described herein.

The invention claimed is:

1. A ball assembly including:

a central mounting core defining a number of core mounting formations; and a number of construction elements which are mountable to the central mounting core in an arrangement wherein the construction elements extend radially outwardly from the central mounting core, the construction elements being configured to define a ball when mounted to the central mounting core in an assembled condition of the ball assembly, each construction element having an inner end and an outer end and a number of side walls extending between the inner and outer ends thereof, the construction elements being configured thereby to permit the construction elements to be located adjacent one another in the assembled condition of the ball assembly in an arrangement wherein each side wall of each construction element abuts a particular one of the side walls of an adjacent construction element, each construction element including a convexly curved outer panel at the outer end of the construction element which defines part of an outer surface of the ball assembly in an assembled condition thereof, the outer panel having a radius of curvature equivalent to the radius of curvature of the outer surface of the ball defined by the ball assembly in its assembled condition, the outer panels of the construction elements being configured and dimensioned so that peripheral edges of each outer panel are bordered by the peripheral edges of the outer panels of adjacent construction elements in the assembled condition of the ball assembly thereby providing the ball assembly with a continuous spherical outer surface, wherein each construction element is one of a pentagonal element having a pentagonal configuration when viewed in cross-section and wherein the outer panel has a pentagonal shape in plan view and a hexagonal element having a hexagonal configuration when viewed in cross-section and wherein the outer panel has a hexagonal shape in plan view, wherein each pentagonal element is in the form of a pentagonal container, wherein each hexagonal element is in the form of a hexagonal container, and wherein each pentagonal and each hexagonal container defines an opening at its inner end, through which flowable material that is contained in the container, can flow, in use.

2. The ball assembly as claimed in claim 1, wherein each construction element includes a complementary element mounting formation for releasably mounting each construction element to a different one of the core mounting formations of the central mounting core.

3. The ball assembly as claimed in claim 2, wherein said element mounting formation is defined at the inner end of the construction element.

4. The ball assembly as claimed in claim 2, wherein each core mounting formation is in the form of an aperture defined in the mounting core, each complementary element mounting formation being in the form of a spigot formation which is locatable within one of the apertures.

5. The ball assembly as claimed in claim 4, wherein the central mounting core is in the form of a hollow sphere having said apertures defined therein.

6. The ball assembly as claimed in claim 1, wherein each construction element includes a concave curved inner wall at the inner end of the construction element, the inner wall having a radius of curvature equivalent to the radius of curvature of an outer surface of the central mounting core.

7. The ball assembly as claimed in claim 1, wherein each pentagonal element includes five side walls of the same shape and configuration, which extend between the outer panel and the inner end of the pentagonal element.

8. The ball assembly as claimed in claim 1, wherein each hexagonal element includes six side walls of the same shape and configuration, which extend between the outer panel and the inner end of the hexagonal element.

9. The ball assembly as claimed in claim 1, wherein the side walls of the pentagonal elements have the same shape and configuration as the side walls of the hexagonal elements thereby permitting the side walls of adjacent hexagonal and pentagonal elements to abut each other in the assembled condition of the ball assembly wherein each pentagonal element is surrounded by five hexagonal elements.

10. The ball assembly as claimed in claim 1, wherein each of the pentagonal and the hexagonal elements tapers from the outer end towards the inner end thereof.

11. The ball assembly as claimed in claim 1, wherein, in its assembled condition, the ball assembly comprises twelve pentagonal elements and twenty hexagonal elements.

12. The ball assembly as claimed in claim 1, wherein the spigot formation of each pentagonal container and each hexagonal container defines a spout which is in flow communication with said opening.

13. The ball assembly as claimed in claim 1, wherein the ball assembly, in its assembled condition, generally defines a truncated icosahedron.

14. The ball assembly as claimed in claim 1, wherein the ball assembly, in its assembled condition, has the appearance of a soccer ball having pentagonal and hexagonal segments on its outer surface.

* * * * *